United States Patent [19]

Bouchard

[11] Patent Number: 4,583,776

[45] Date of Patent: Apr. 22, 1986

[54] DOUBLE PURPOSE SECURITY PLATE

[76] Inventor: Donald J. Bouchard, 3920 S. 3rd Ave., Phoenix, Ariz. 85041

[21] Appl. No.: 585,924

[22] Filed: Mar. 2, 1984

[51] Int. Cl.[4] ..... E05B 17/20

[52] U.S. Cl. ..... 292/346

[58] Field of Search ..... 292/346; 70/416, 452, 70/418, 450

[56] References Cited

U.S. PATENT DOCUMENTS

| | | | |
|---|---|---|---|
| 1,814,961 | 7/1931 | Phillips | 292/346 |
| 2,144,075 | 1/1939 | Mora | 292/346 |
| 3,405,962 | 10/1968 | Sushan | 292/346 |
| 3,592,498 | 7/1971 | Raccuglia | 292/346 |
| 3,673,605 | 6/1972 | Allenbaugh | 292/346 |
| 3,764,173 | 10/1973 | Griffith | 292/346 |
| 3,825,291 | 7/1974 | Sprunger | 292/346 |
| 3,967,845 | 7/1976 | Governale | 292/346 X |
| 4,183,568 | 1/1980 | Ferracane | 292/346 X |
| 4,189,175 | 2/1980 | Paxton | 292/346 X |

FOREIGN PATENT DOCUMENTS

| | | | |
|---|---|---|---|
| 65912 | 3/1943 | Norway | 292/346 |
| 205943 | 11/1923 | United Kingdom | 292/346 |

*Primary Examiner*—Kenneth J. Dorner
*Assistant Examiner*—Lloyd A. Gall
*Attorney, Agent, or Firm*—M. David Shapiro

[57] ABSTRACT

The invention comprises a design improvement on security plates of the type which are designed to prevent unauthorized entry through a door equipped with a door latch set by means of the use of a credit card or the like. The improvement provides a single security plate equipped with a double ended design which provides for installation on either in inward swinging or an outward swinging door.

4 Claims, 3 Drawing Figures

DOUBLE PURPOSE SECURITY PLATE

FIELD OF THE INVENTION

The invention relates to an improved security plate of the type which prevents unauthorized entry through a door which is equipped with conventional door latch hardware. The invention comprises a security plate with a double ended design feature which allows the plate to be effectively mounted on either an inward or an outward swinging door.

BACKGROUND OF THE INVENTION

It is well known that it is common practice to use a credit card or a similar thin, flexible instrument to disengage a door latch in a door for the purpose of illegal entry therethrough. The instrument is placed between the door and the jam at the position of the latch mechanism and is used to force the latch bolt back into the door (out of the latch or striker plate) to allow opening of the door.

Guard plates for the prevention of such illegal entry are commonly sold. Many institutions fabricate such plates for use in their facilities. These prior art security plates are believed to be designed and fabricated to fit a particular door/latch set combination, depending upon whether the door opens inward (toward the area to be secured) or outward (away from the area to be secured. U.S. Pat. Nos. 3,888,530, issued to Fabrici; 3,764,173 issued to Griffith; 2,144,075, issued to Mora; 4,183,568, issued to Ferracane; 3,761,119, issued to Bennett et al.; and 3,405,962, issued to Sushan, are illustrative of the state of the art.

These prior art designs are intended for use on only one side of a door and are not adaptable to either outward or inward opening doors. It would also be advantageous to provide a security plate which is adjustable for setback dimension differences due to tolerances of installation and lock mechanism diameters.

SUMMARY OF THE INVENTION

These and other problems demonstrated by prior art security plates are resolved by the present security plate invention. The design of the improved security plate of the invention provides a means for installation on the outer (nonsecure) side of a door whether the door is an inward or outward opening door. This is accomplished by providing bent features on each of two opposing ends of the security plate of the invention so that one end may be installed for cooperation with a door stop to prevent insertion of a credit card or the like and the other end may be installed for cooperation with a latch or striker plate to prevent that same insertion.

It is therefore an object of the invention to provide a single security plate for the prevention of unauthorized access through a locked door, said security plate being installable in either of two positions relative to the locking mechanism for providing security on either an outward or an inward opening door.

It is another object of the invention to provide a dual use security plate which is adjustable in position to provide a snug fit against either a striker plate or a door stop.

It is still another object of the invention to provide a security plate which is adaptable to a range of lock mechanism sizes.

These and other objects of the invention will be more readily understood upon study of the Detailed Description of The Invention, below, together with the drawings in which.

DETAILED DESCRIPTION OF THE INVENTION

Figure 1:
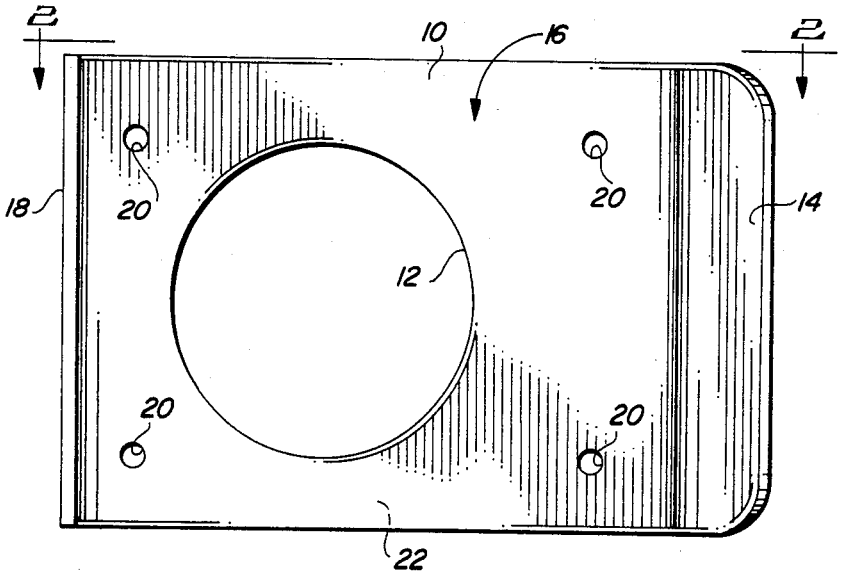
FIG. 1 is a frontal view of the security plate of the invention.

Referring first to FIG. 1, security plate 10 has clearance hole 12 therein. Hole 12 may advantageously have a diameter of approximately two and one-eighth inches. End feature 14 is bent up at an angle of approximately forty-five degrees from the main body 16 of plate 10. End feature 18 is bent up at an angle of approximately ninety degrees with respect to main body 16 of plate 10. These angles will be better understood by observance of the same features (which are identified by the same reference numerals) in FIGS. 2 and 3. Four holes 20 are provided in plate 10. While four of these holes 20 are shown, any number may be utilized.

End features 14 and 18 are approximately three-quarters of an inch long as measured from the back surface 22 of plate 10 along the back side of each bent end 14, 18.

Figure 2:
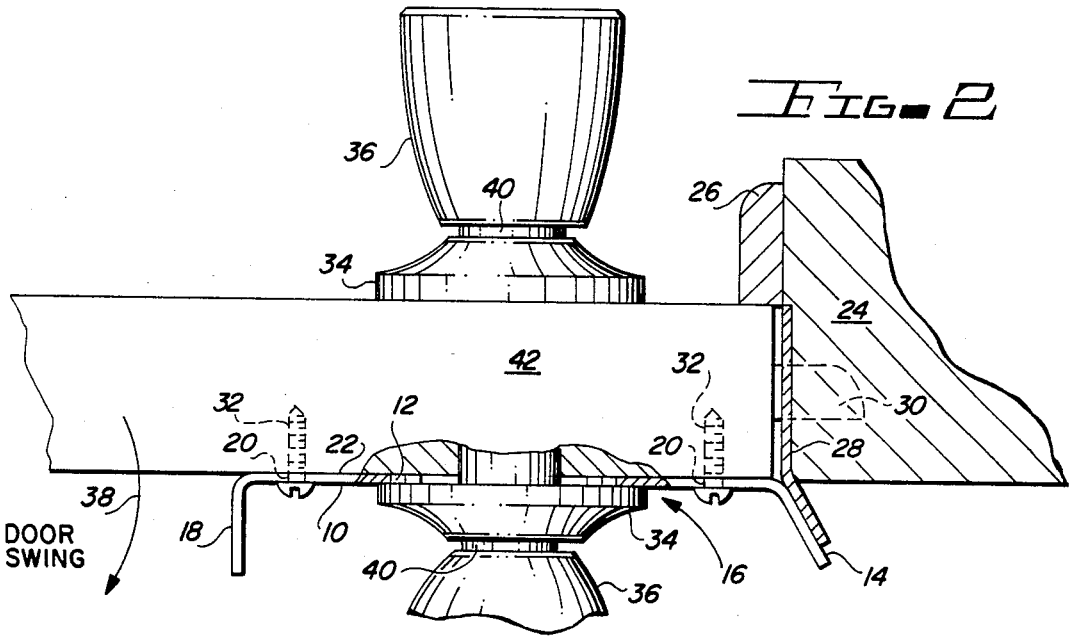
FIG. 2 is a top view of the security plate of FIG. 1, shown installed on an outward opening door.

FIG. 2 illustrates security plate 10 mounted on an outwardly swinging 38 door 42. Further, it depicts plate 10 as it would be seen from the top of FIG. 1. Hole 12 in plate 10 is large enough to clear shaft 40 of the lock mechanism as installed on door 42. Shaft 40 supports door knob 36 and provides the necessary linkage from knob 36 to the lock spring latch or bolt mechanism. Hole 12 is, in fact, large enough to allow significant adjustment of the position of plate 10 on door 42 so that end 14 may be placed in close association to and cooperate with striker plate 28 to assure that there will be no room for a credit card or other such thin device to be inserted between end 14 and striker plate 28 when door 42 is closed against door stop 26. On the other hand, hole 12 is small enough to be concealed in installation by escutcheon plate 34, a part of the usual lock mechanism.

Striker plate 28 is mounted in the usual way on door jam 24 and bolt or spring latch 30 engages a hole (not shown) in striker plate 28 when door 42 is closed.

After plate 10 is located on door 42 so that there is inadequate clearance for a credit card or other opening device, one or more anti-rotation fasteners 32 may be installed through holes 20 to assure that plate 10 remains in a stable position on door 42 and retains its position with respect to striker plate 28. The forty-five degree angle (135 degree included angle) of bent end 14 has proven to be a very good design choice in that it has allowed end 14 to be tightly adjusted against a large number of striker plate 28 designs. While very snug fits have been accomplished, there have been no problems concerning interferences between striker plate 28 and bent end 14 after installation.

Figure 3:
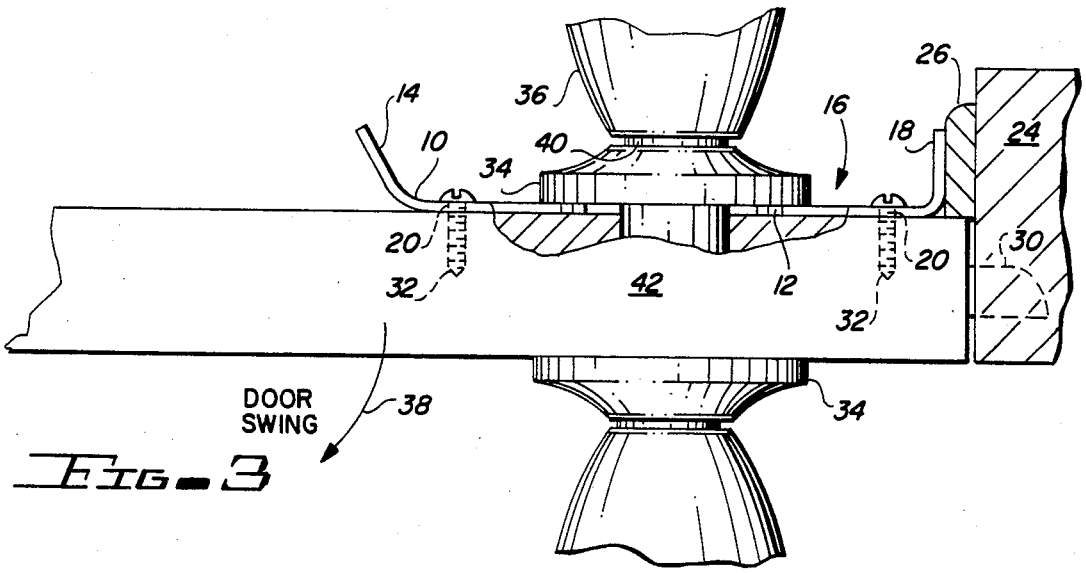
FIG. 3 is a top view of the security plate of the invention, shown installed on an inwardly opening door.

FIG. 3 illustrates the security plate of the invention installed on door 42 where door opens and swings 38 inwardly (toward the area secured by the door). This top view of the invention shows that it has been mounted so that ninety degree bent end 18 is in close proximity to door stop 26 on the outer side of door 42. Otherwise, the installation is identical to that of FIG. 2.

Oversized hole 12 allows the position of plate 10 to be closely controlled to fit snugly against door stop 26 to provide the same protection as was afforded by the configuration of FIG. 2. Again, as in the configuration of FIG. 2, after the adjustment of the position of plate 10 is established, one or more antirotation fasteners 32 may be installed.

While the invention has been particularly shown and described with reference to a preferred embodiment thereof, it will be understood by one having ordinary skill in the art that various other modifications and changes may be made to the present invention from the principles of the invention described herein without departing from the spirit and scope thereof, as encompassed in the accompanying claims. Therefore, it is intended in the appended claims to cover all such equivalent variations which do essentially the same thing in essentially the same way to produce the same result which come within the scope of the invention as described.

What is claimed is:

1. An improved swingable door security plate assembly, the improved security plate for preventing the use of a credit card, or the like, from being used to retract a spring or bolt latch on the door, when the swingable door is closed, from a cooperating latch plate which is installed on a mating door jamb, the mating door jamb being equipped with a door stop, the improvement comprising:

a swingable door;

double ended plate means for mounting on an outside surface of said swingable door, said double ended plate means further comprising:

a main body, said main body having a clearance hole means therethrough for clearing a door set on said outside surface of said swingable door;

a first bent end, said first bent end being bent up from said main body at an angle of approximately forty-five degrees; and a second bent end, said second bent end being bent up from said main body at an angle of approximately ninety degrees, said double ended plate means being mounted so that one of said first and second bent ends of said plate means is adjacent and cooperatively close to one of the latch plate and the door stop, respectively, when said door is in the closed position.

2. The improved assembly according to claim 1 wherein said clearance hole means is approximately two and one-eighth inches in diameter.

3. The improved assembly according to claim 1 wherein said main body has therethrough at least one anti-rotational hole means for cooperating with a fastener for preventing said double ended plate means from rotating about said door set on said outside surface of said swingable door.

4. The improved assembly according to claim 3 wherein said clearance hole means is approximately two and one-eighth inches in diameter.

* * * * *